US005813140A

United States Patent [19]

Obeid

[11] Patent Number: 5,813,140

[45] Date of Patent: Sep. 29, 1998

[54] VENTILATED SHOE

[76] Inventor: Abdelhakim R. Obeid, 61 Amsterdam Pl., Staten Island, N.Y. 10314

[21] Appl. No.: 885,523

[22] Filed: Jun. 30, 1997

[51] Int. Cl.[6] ..... A43B 7/06; A43B 13/20

[52] U.S. Cl. ..... 36/3 R; 36/3 A; 36/3 B

[58] Field of Search ..... 636/3 R, 3 A, 636/3 B, 28, 29

[56] References Cited

U.S. PATENT DOCUMENTS

| | | | |
|---|---|---|---|
| 2,741,038 | 4/1956 | Eliassen | 36/3 R |
| 3,027,659 | 4/1962 | Gianola | 36/3 R |
| 3,128,566 | 4/1964 | Burlison et al. | 36/3 R |
| 3,331,146 | 7/1967 | Karras | 36/3 R |
| 4,571,856 | 2/1986 | Lin et al. | 36/3 A |
| 5,333,397 | 8/1994 | Hausch | 36/3 B |
| 5,341,581 | 8/1994 | Huang | 36/3 B |
| 5,375,345 | 12/1994 | Djuric | 36/3 B |

FOREIGN PATENT DOCUMENTS

| | | | |
|---|---|---|---|
| 88634 | 11/1956 | Norway | 36/3 R |
| 114095 | 6/1925 | Switzerland | 36/3 R |
| 2189679 | 11/1987 | United Kingdom | 36/3 B |

*Primary Examiner*—M. D. Patterson

[57] ABSTRACT

A ventilated shoe is provided including an entry conduit having a first open end in communication with an exterior of the shoe. A bladder is positioned within a sole of the shoe adjacent a heel portion thereof. A rear extent of the bladder resides in communication with a second end of the entry conduit. The bladder is adapted to be compressed upon the shoe engaging the ground and further return to an original shape thereof upon the shoe disengaging the ground. At least one exit conduit is provided having a first end in communication with a front extent of the bladder and a second end positioned within the sole and in communication with at least one bore formed in the sole. Also included is a pair of one-way valves with a first valve positioned within the entry conduit in communication with the bladder and a second valve positioned between the bladder and the exit conduits. Lastly, the exit passage includes a central conduit having an end extended through the upper toe portion of the upper body of the shoe. The central conduit has a bore formed in the end of the central conduit which is directed rearwardly.

6 Claims, 3 Drawing Sheets

VENTILATED SHOE

BACKGROUND OF THE INVENTION

1. Field of the Invention

The present invention relates to a ventilated shoe and more particularly pertains to providing the complete ventilation of a shoe while in use.

2. Description of the Prior Art

The use of ventilated footwear is known in the prior art. More specifically, cooling a shoe heretofore devised and utilized for the purpose of ventilated footwear are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,375,345 to Djuric; U.S. Pat. No. 4,835,883 to Terault et al.; U.S. Pat. No. 3,973,336 to Ahn; U.S. Pat. No. 5,400,526 to Sessa; U.S. Pat. No. 5,195,254 to Tyng; and U.S. Pat. No. 4,776,110 to Shiang.

In this respect, the ventilated shoe according to the present invention substantially departs from the conventional concepts and designs of the prior art, and in so doing provides an apparatus primarily developed for the purpose of providing the complete ventilation of a shoe while in use.

Therefore, it can be appreciated that there exists a continuing need for a new and improved ventilated shoe which can be used for providing the complete ventilation of a shoe while in use. In this regard, the present invention substantially fulfills this need.

SUMMARY OF THE INVENTION

In view of the foregoing disadvantages inherent in the known types of ventilated footwear now present in the prior art, the present invention provides an improved ventilated shoe. As such, the general purpose of the present invention, which will be described subsequently in greater detail, is to provide a new and improved ventilated shoe which has all the advantages of the prior art and none of the disadvantages.

To attain this, the present invention essentially comprises a shoe having a horizontally oriented flexible sole and an upper body. As best shown in FIG. 1, the upper body of the shoe includes a bevelled upper toe portion, a lace portion integrally connected to the toe portion, a vertical heel portion, and a pair of side portions. The side portions are integrally connected between the upper toe portion, the lace portion, and the heel portion for defining an interior space with an open top for inserting a foot within the shoe. A plurality of apertures are formed in the upper toe portion of the upper body of the shoe below the lace portion thereof for allowing air to exit the interior space of the shoe. As best shown in FIGS. 3 & 4, an entry conduit is included having a first open end in communication with an upper edge of the heel portion. As shown in FIG. 3, the entry conduit is vertically oriented within a central extent of the heel portion. Next provided is a bladder having a oval configuration and positioned within the sole adjacent the heel portion thereof. A rear extent of the bladder resides in communication with a second end of the entry conduit. It should be noted that the bladder is adapted to be compressed upon the shoe engaging the ground and further return to an original shape thereof upon the shoe disengaging the ground. A plurality of exit conduits are provided including a pair of horizontally oriented linear side conduits. Each of the linear side conduits have a first end in communication with a front extent of the bladder. A second end is positioned within the sole adjacent a point where the upper toe portion and respective side portions of the upper body of the shoe connect with the sole. The side conduits include a first pair of bores formed in the sole between the interior space of the shoe and midpoints of the side conduits. The side conduits further include a second pair of bores formed in the sole between the interior space of the shoe and ends of the side conduits. The exit conduits further include a central conduit having a first end in communication with the front extent of the bladder. A second end of the central conduit is extended through the upper toe portion of the upper body of the shoe. For providing communication between the interior of the shoe and the central conduit, the central conduit includes a first pair of bores formed in the sole between the interior space of the shoe and a central extent of the central conduit. Associated therewith is a second bore formed in the second end of the central conduit. Also included is a pair of valves each having a housing with a central spherical compartment. Note FIG. 5. A single entry passage is formed in communication with a central extent of the spherical compartment. In communication with outer ends of the spherical compartment opposite of the single entry passage is a pair of spaced and parallel exit passages. Further provided is a spherical ball having a diameter slightly less than that of the spherical compartment. In use, the spherical ball precludes air from flowing from the exit passages to the entry passage and further allows air to flow from the entry passage to the exit passages. As shown in FIG. 3, the valves include a first valve positioned within the entry conduit adjacent the first end thereof. The exit passages of the first valve are in communication with the bladder and the entry passage thereof is in communication with an exterior of the shoe. Yet another valve is positioned between the bladder and the exit conduits with the exit passages thereof in communication with the exit conduits. The entry passage of the second valve resides in communication with the bladder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ventilated shoe which has all the advantages of the prior art ventilated footwear and none of the disadvantages.

It is another object of the present invention to provide a new and improved ventilated shoe which may be easily and efficiently manufactured and marketed.

It is a further object of the present invention to provide a new and improved ventilated shoe which is of a durable and reliable construction.

An even further object of the present invention is to provide a new and improved ventilated shoe which is susceptible of a low cost of manufacture with regard to both materials and labor, and which accordingly is then susceptible of low prices of sale to the consuming public, thereby making such ventilated shoe economically available to the buying public.

Still yet another object of the present invention is to provide a new and improved ventilated shoe which provides in the apparatuses and methods of the prior art some of the advantages thereof, while simultaneously overcoming some of the disadvantages normally associated therewith.

Still another object of the present invention is to provide the complete ventilation of a shoe while in use.

Lastly, it is an object of the present invention to provide a new and improved ventilated shoe is provided including an entry conduit having a first open end in communication with an exterior of the shoe. A bladder is positioned within a sole of the shoe adjacent a heel portion thereof. A rear extent of the bladder resides in communication with a second end of the entry conduit. The bladder is adapted to be compressed upon the shoe engaging the ground and further return to an original shape thereof upon the shoe disengaging the ground. At least one exit conduit is provided having a first end in communication with a front extent of the bladder and a second end positioned within the sole and in communication with at least one bore formed in the sole. Also included is a pair of one-way valves with a first valve positioned within the entry conduit in communication with the bladder and a second valve positioned between the bladder and the exit conduits. Lastly, the exit passage includes a central conduit having an end extended through the upper toe portion of the upper body of the shoe. The central conduit has a bore formed in the end of the central conduit which is directed rearwardly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
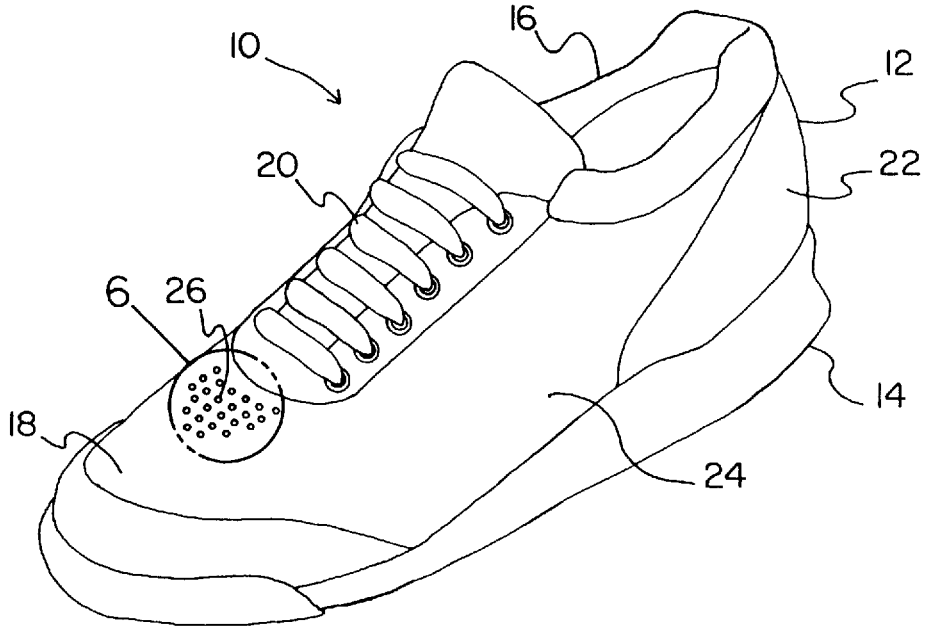
FIG. 1 is a perspective illustration of the preferred embodiment of the ventilated shoe constructed in accordance with the principles of the present invention.
Figure 2:
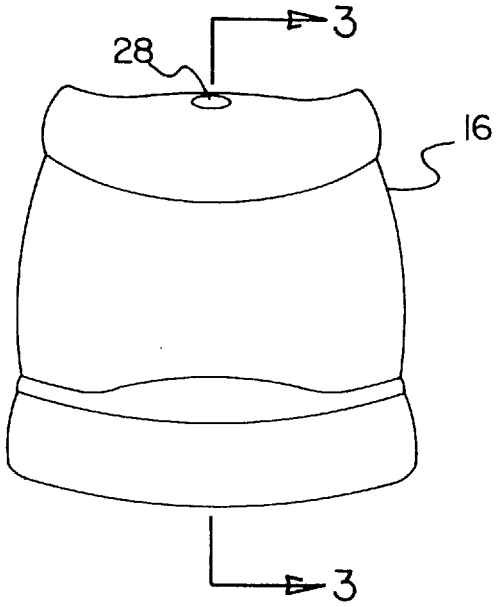
FIG. 2 is a rear view of the present invention.

With reference now to the drawings, and in particular to FIG. 1 thereof, a new and improved ventilated shoe embodying the principles and concepts of the present invention and generally designated by the reference numeral 10 will be described.

The present invention, the new and improved ventilated shoe, is comprised of a plurality of components. Such components in their broadest context include a shoe, a plurality of apertures, an entry conduit, a plurality of exit conduits, and a pair of valves. Such components are individually configured and correlated with respect to each other so as to attain the desired objective.

More specifically, it will be noted that the system 10 of the present invention includes a shoe 12 having a horizontally oriented flexible sole 14 and an upper body 16. As best shown in FIG. 1, the upper body of the shoe includes a bevelled upper toe portion 18, a lace portion 20 integrally connected to the toe portion, a vertical heel portion 22, and a pair of side portions 24. The side portions are integrally connected between the upper toe portion, the lace portion, and the heel portion for defining an interior space with an open top for inserting a foot within the shoe.

A plurality of apertures 26 are formed in the upper toe portion of the upper body of the shoe below the lace portion thereof for allowing air to exit the interior space of the shoe. In the preferred embodiment, approximately 24 apertures are formed.

Figure 3:
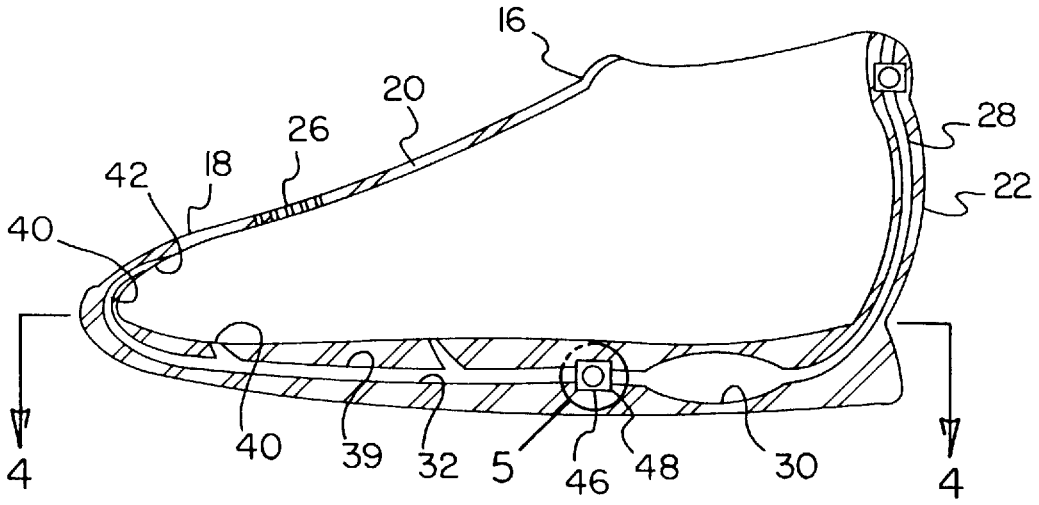
FIG. 3 is a side cross-sectional view of the present invention.
Figure 4:
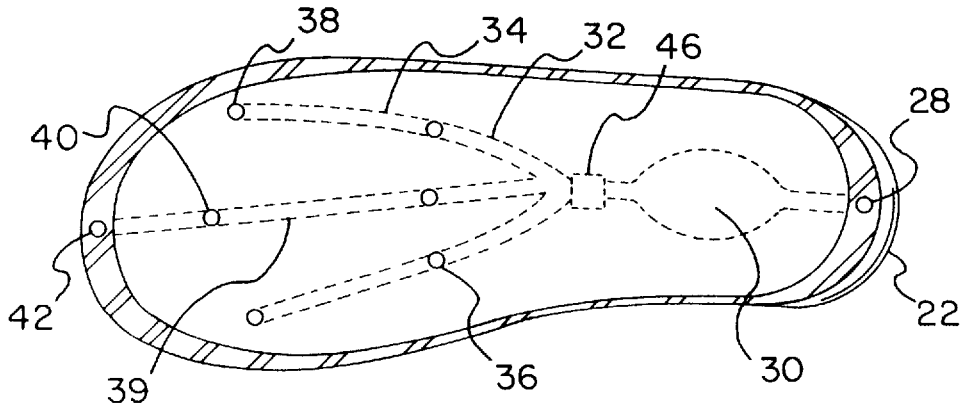
FIG. 4 is a top cross-sectional view of the present invention.

As best shown in FIGS. 3 & 4, an entry conduit 28 is included having a first open end in communication with an upper edge of the heel portion. As shown in FIG. 3, the entry conduit is vertically oriented within a central extent of the heel portion.

Next provided is a bladder 30 having an oval configuration and positioned within the sole adjacent the heel portion thereof. A rear extent of the bladder resides in communication with a second end of the entry conduit. It should be noted that the bladder is adapted to be compressed upon the shoe engaging the ground while worn and further return to an original shape thereof upon the shoe disengaging the ground.

A plurality of exit conduits 32 are provided including a pair of horizontally oriented linear side conduits 34. In the preferred embodiment, the side conduits form a 30 degree angle with a central axis of the shoe. Each of the linear side conduits have a first end in communication with a front extent of the bladder. A second end is positioned within the sole adjacent a point where the upper toe portion and respective side portions of the upper body of the shoe connect with the sole. The side conduits include a first pair of bores 36 formed in the sole between the interior space of the shoe and midpoints of the side conduits. The side conduits further include a second pair of bores 38 formed in the sole between the interior space of the shoe and ends of the side conduits. As such, the bores are situated below the arc and toes of the foot.

The exit conduits further include a central conduit 39 having a first end in communication with the front extent of the bladder. A second end of the central conduit is extended through the upper toe portion of the upper body of the shoe. For providing communication between the interior of the shoe and the central conduit, the central conduit includes a first pair of bores 40 formed in the sole between the interior space of the shoe and a central extent of the central conduit. Associated therewith is a second bore 42 formed in the second end of the central conduit. As shown in FIG. 3, the portion 44 of the central conduit adjacent the second end thereof resides in a vertical plane and has U-shaped configuration for following the contour of the shoe. By this structure, the second bore is directed rearwardly toward a top of the toes of the user.

Figure 5:
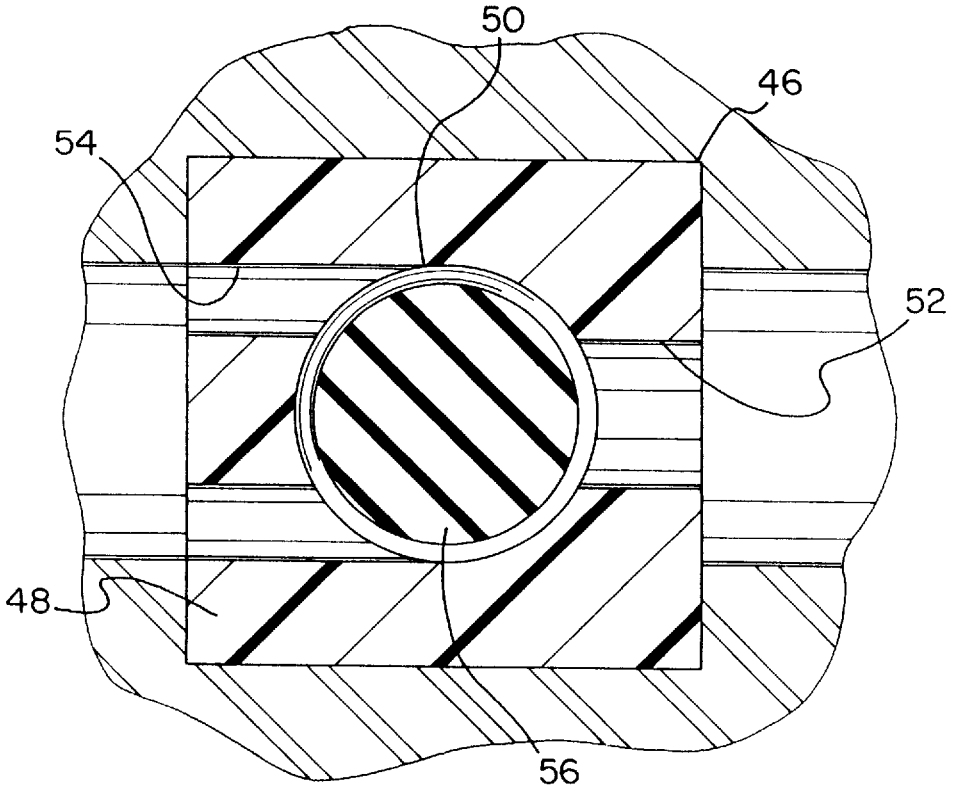
FIG. 5 is a close-up view of the valves of the present invention.
Figure 6:
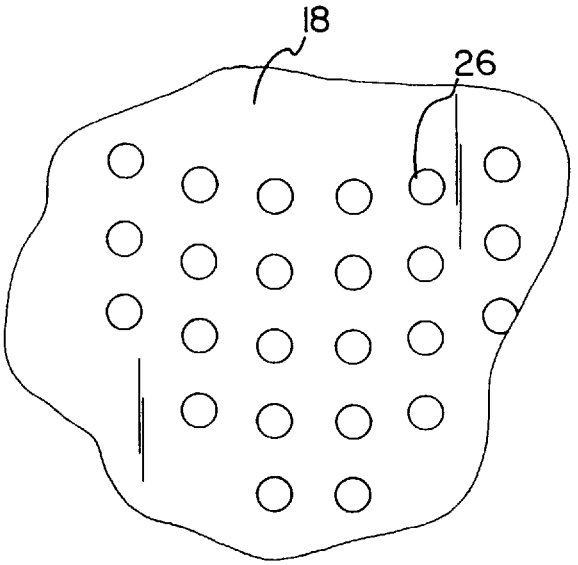
FIG. 6 is a close-up view of the apertures formed in the upper toe portion of the present invention.

Also included is a pair of valves 46 each having a square housing 48 with a central spherical compartment 50. Note FIG. 5. A single entry passage 52 is formed in communication with a central extent of the spherical compartment. In communication with outer ends of the spherical compartment opposite of the single entry passage is a pair of spaced and parallel exit passages 54. Further provided is a spherical ball 56 situated within the compartment and having a diameter slightly less than that of the spherical compartment. In use, the spherical ball precludes air from flowing from the exit passages to the entry passage and further allows air to flow from the entry passage to the exit passages. To accomplish this, the ball is not capable of covering both exit apertures but yet is adapted to cover the single entry aperture.

As shown in FIG. 3, the valves include a first valve positioned within the entry conduit adjacent the first end thereof. The exit passages of the first valve are in communication with the bladder and the entry passage thereof is in communication with an exterior of the shoe. Yet another valve is positioned between the bladder and the exit conduits with the exit passages thereof in communication with the exit conduits. The entry passage of the second valve resides in communication with the bladder. By this structure, the valves work together to allow the flow of air to the interior space of the shoe.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ventilated shoe comprising, in combination:

a shoe having a horizontally oriented flexible sole and an upper body, the upper body of the shoe including a bevelled upper toe portion, a lace portion integrally connected to the toe portion, a vertical heel portion, and a pair of side portions integrally connected between the upper toe portion, the lace portion, and the heel portion for defining an interior space with an open top for inserting a foot within the shoe;

a plurality of apertures formed in the upper toe portion of the upper body of the shoe below the lace portion thereof for allowing air to exit the interior space of the shoe;

an entry conduit having a first open end in communication with an upper edge of the heel portion, the entry conduit being vertically oriented within a central extent of the heel portion;

a bladder having a oval configuration and positioned within the sole adjacent the heel portion thereof, a rear extent of the bladder being in communication with a second end of the entry conduit and adapted to be compressed upon the shoe engaging the ground and further return to an original shape thereof upon the shoe disengaging the ground;

a plurality of exit conduits including a pair of horizontally oriented linear side conduits each having a first end in communication with a front extent of the bladder and a second end positioned within the sole adjacent a point where the upper toe portion and respective side portions of the upper body of the shoe connect with the sole, the side conduits including a first pair of bores formed in the sole between the interior space of the shoe and midpoints of the side conduits and a second pair of bores formed in the sole between the interior space of the shoe and ends of the side conduits, the exit conduits further including a central conduit having a first end in communication with the front extent of the bladder and a second end extended through the upper toe portion of the upper body of the shoe, the central conduit including a first pair of bores formed in the sole between the interior space of the shoe and a central extent of the central conduit and a second bore formed in the second end of the central conduit; and a pair of valves each having a housing including a central spherical compartment, a single entry passage in communication with a central extent of the spherical compartment, a pair of spaced and parallel exit passages in communication with outer ends of the spherical compartment, and a spherical ball having a diameter slightly less than that of the spherical compartment, the spherical ball precluding air from flowing from the exit passages to the entry passage and allowing air to flow from the entry passage to the exit passages, the valves including a first valve positioned within the entry conduit adjacent the first end thereof with the exit passages thereof in communication with the bladder and the entry passage thereof in communication with an exterior of the shoe and a second valve positioned between the bladder and the exit conduits with the exit passages thereof in communication with the exit conduits and the entry passage thereof in communication with the bladder.

2. A ventilated shoe comprising:

a shoe having a horizontally oriented flexible sole and an upper body, the upper body of the shoe including a bevelled upper toe portion, a lace portion integrally connected to the toe portion, a vertical heel portion, and a pair of side portions integrally connected between the upper toe portion, the lace portion, and the heel portion for defining an interior space with an open top for inserting a foot within the shoe;

an entry conduit having a first open end in communication with an exterior of the shoe;

a bladder positioned within the sole adjacent the heel portion thereof, a rear extent of the bladder being in communication with a second end of the entry conduit and adapted to be compressed upon the shoe engaging the ground and further return to an original shape thereof upon the shoe disengaging the ground;

at least one exit conduit having a first end in communication with the bladder and a second end positioned within the sole and in communication with at least one bore formed in the sole; and a pair of valves each having a housing including a central spherical compartment, a single entry passage in communication with a central extent of the spherical compartment, a pair of spaced and parallel exit passages in communication with outer ends of the spherical compartment, and a spherical ball having a diameter slightly less than that of the spherical compartment, the spherical ball precluding air from flowing from the exit passages to the entry passage and allowing air to flow from the entry passage to the exit passages, the valves including a first valve positioned within the entry conduit and a second valve positioned between the bladder and the exit conduits.

3. A ventilated shoe as set forth in claim 2 wherein the at least one exit conduit includes a pair of horizontally oriented linear side conduits each having a first end in communication with a front extent of the bladder and a second end positioned within the sole adjacent a point where the upper toe portion and respective side portions of the upper body of the shoe connect with the sole, the side conduits including a first pair of bores formed in the sole between the interior space of the shoe and midpoints of the side conduits and a second pair of bores formed in the sole between the interior space of the shoe and ends of the side conduits.

4. A ventilated shoe as set forth in claim 2 wherein the exit conduit includes a central conduit having a first end in communication with the front extent of the bladder and a second end extended through the upper toe portion of the upper body of the shoe, the central conduit including a bore formed in the second end of the central conduit.

5. A ventilated shoe as set forth in claim 2 and further including a plurality of apertures formed in the upper toe portion of the upper body of the shoe below the lace portion thereof for allowing air to exit the interior space of the shoe.

6. A ventilated shoe comprising:

a shoe having a horizontally oriented flexible sole and an upper body, the upper body of the shoe including a bevelled upper toe portion, a lace portion integrally connected to the toe portion, a vertical heel portion, and a pair of side portions integrally connected between the upper toe portion, the lace portion, and the heel portion for defining an interior space with an open top for inserting a foot within the shoe;

an entry conduit having a first open end in communication with an exterior of the shoe;

a bladder positioned within the sole adjacent the heel portion thereof, a rear extent of the bladder being in communication with a second end of the entry conduit and adapted to be compressed upon the shoe engaging the ground and further return to an original shape thereof upon the shoe disengaging the ground;

at least one exit conduit having a first end in communication with a front extent of the bladder and a second end positioned within the sole and in communication with at least one bore formed in the sole; and a pair of one-way valves including a first valve positioned within the entry conduit in communication with the bladder and a second valve positioned between the bladder and the exit conduits;

wherein the exit passage includes a second end extended through the upper toe portion of the upper body of the shoe with a bore formed in the second end and directed rearwardly.

* * * * *